US006651685B2

(12) United States Patent
Connelly et al.

(10) Patent No.: US 6,651,685 B2
(45) Date of Patent: Nov. 25, 2003

(54) CHILDRENS' PLAY AREA SUNSHADE CANOPY

(76) Inventors: Kevin T. Connelly, 4487 A-B Ashton Rd., Sarasota, FL (US) 34233; Ernesto De Oliviera, 4348 Pasadena Cir., Sarasota, FL (US) 34233

( * ) Notice: Subject to any disclaimer, the term of this patent is extended or adjusted under 35 U.S.C. 154(b) by 76 days.

(21) Appl. No.: 09/960,483

(22) Filed: Sep. 24, 2001

(65) Prior Publication Data

US 2003/0056818 A1 Mar. 27, 2003

(51) Int. Cl.[7] ..... E04H 15/58
(52) U.S. Cl. ..... 135/117; 135/119
(58) Field of Search ..... 135/117, 121, 135/123, 119, 135, 139, 87, 900, 902, 908; 403/292, 345

(56) References Cited

U.S. PATENT DOCUMENTS 4,793,371 A * 12/1988 O'Ferrell et al. ..... 135/119 X
5,040,557 A * 8/1991 Morgan ..... 135/119 X
5,331,992 A * 7/1994 Gremont ..... 135/119 X
5,641,192 A * 6/1997 Smith et al. ..... 135/117 X
5,709,238 A * 1/1998 Mattioli ..... 135/117 X
6,155,280 A * 12/2000 Powell et al. ..... 135/119 X

FOREIGN PATENT DOCUMENTS

GB 11624 * 9/1900 ..... 135/117

* cited by examiner

*Primary Examiner*—James O. Hansen
(74) *Attorney, Agent, or Firm*—Werner H. Schroeder

(57) ABSTRACT

A demountable, wind-resistant sun shade canopy for shading childrens' play areas or other actively used areas. The canopy cover, being removably secured over a metal support structure, is comprised of vertical columns upon which are mounted at the upper end thereof respectively, uniquely configured bracket fittings, each bracket fitting providing secure mounting for a cantilever beam extending outwardly toward the perimeter of the area to be shaded, and providing secure mounting for a hip beam extending upward and toward the inner portion of the area to be shaded.

4 Claims, 8 Drawing Sheets

FIG. 1
PRIOR ART
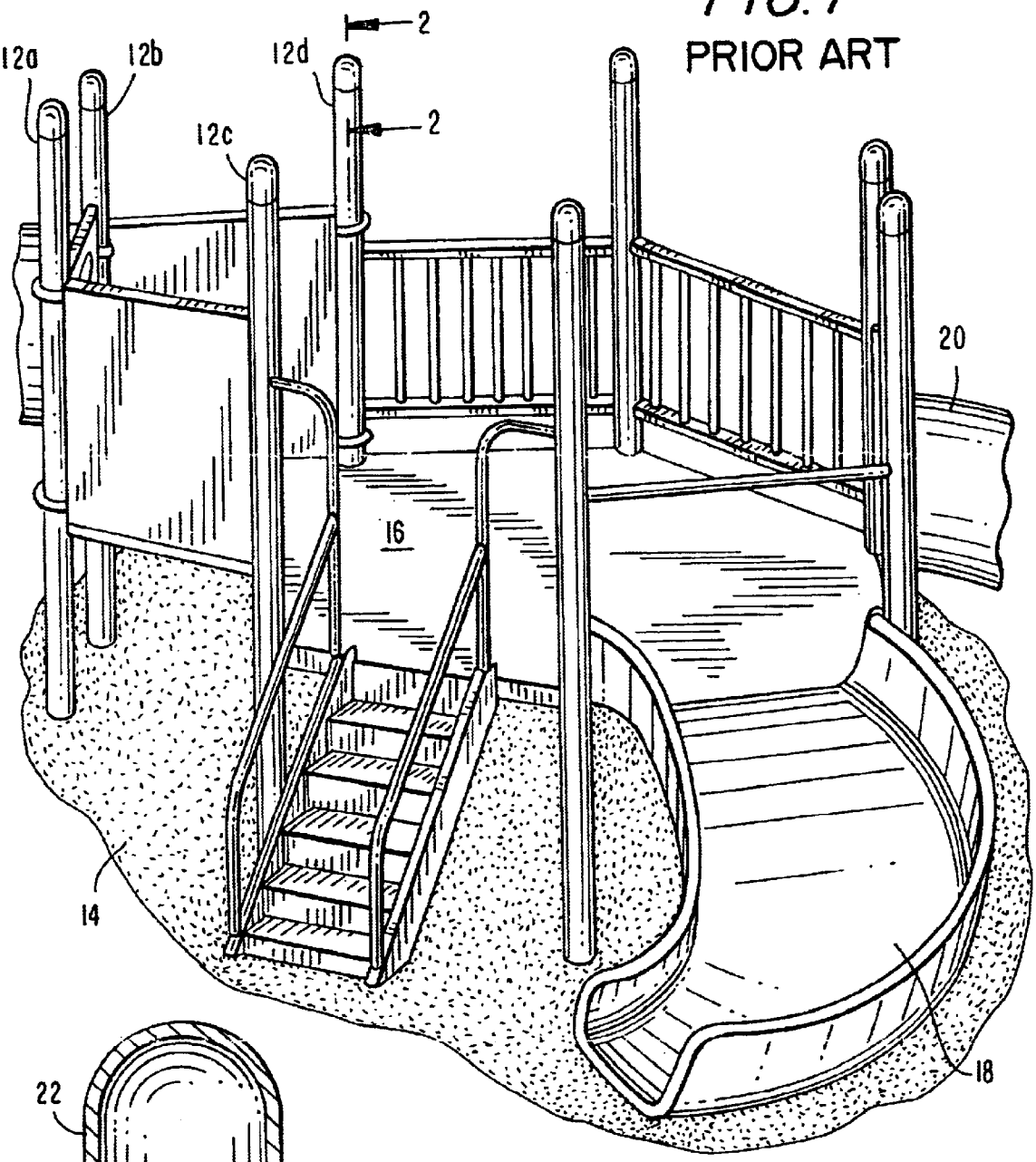
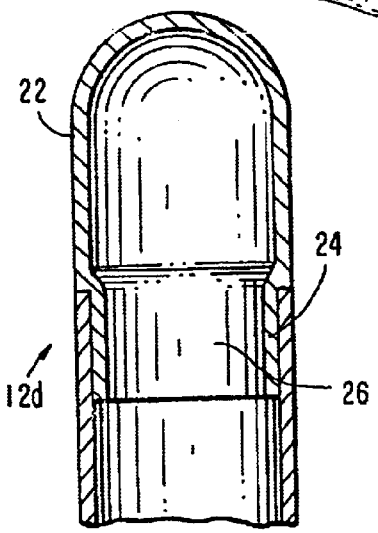
FIG. 2 PRIOR ART

FIG. 5
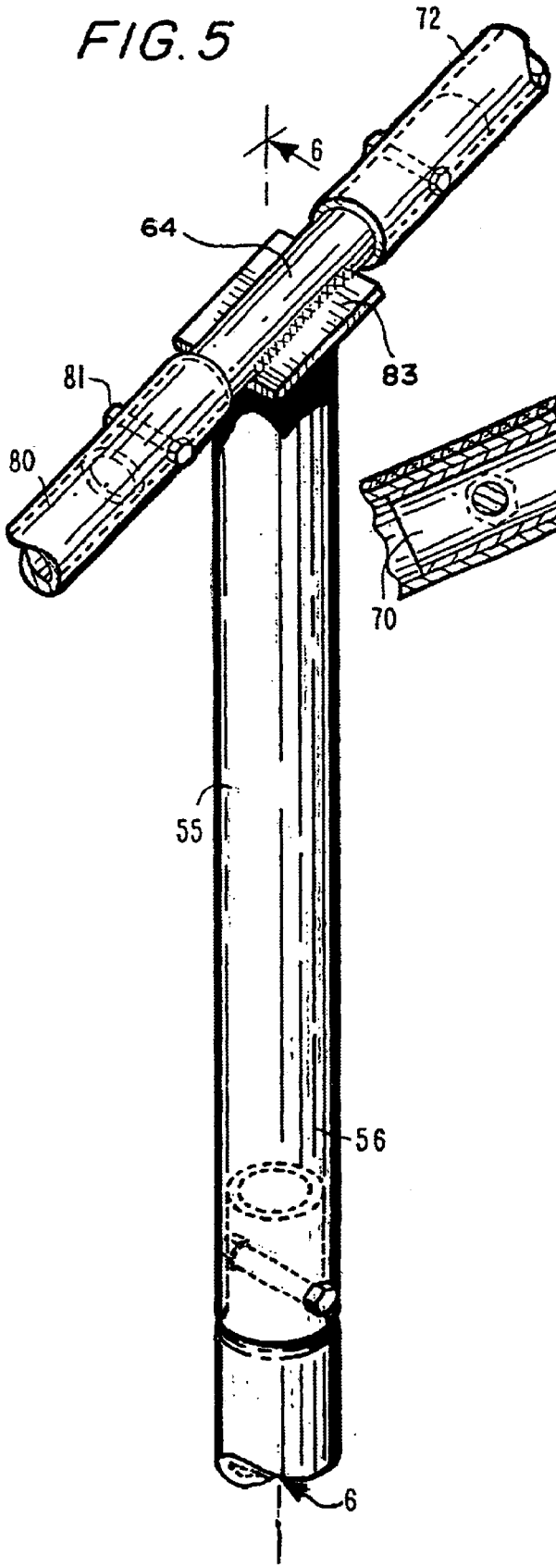
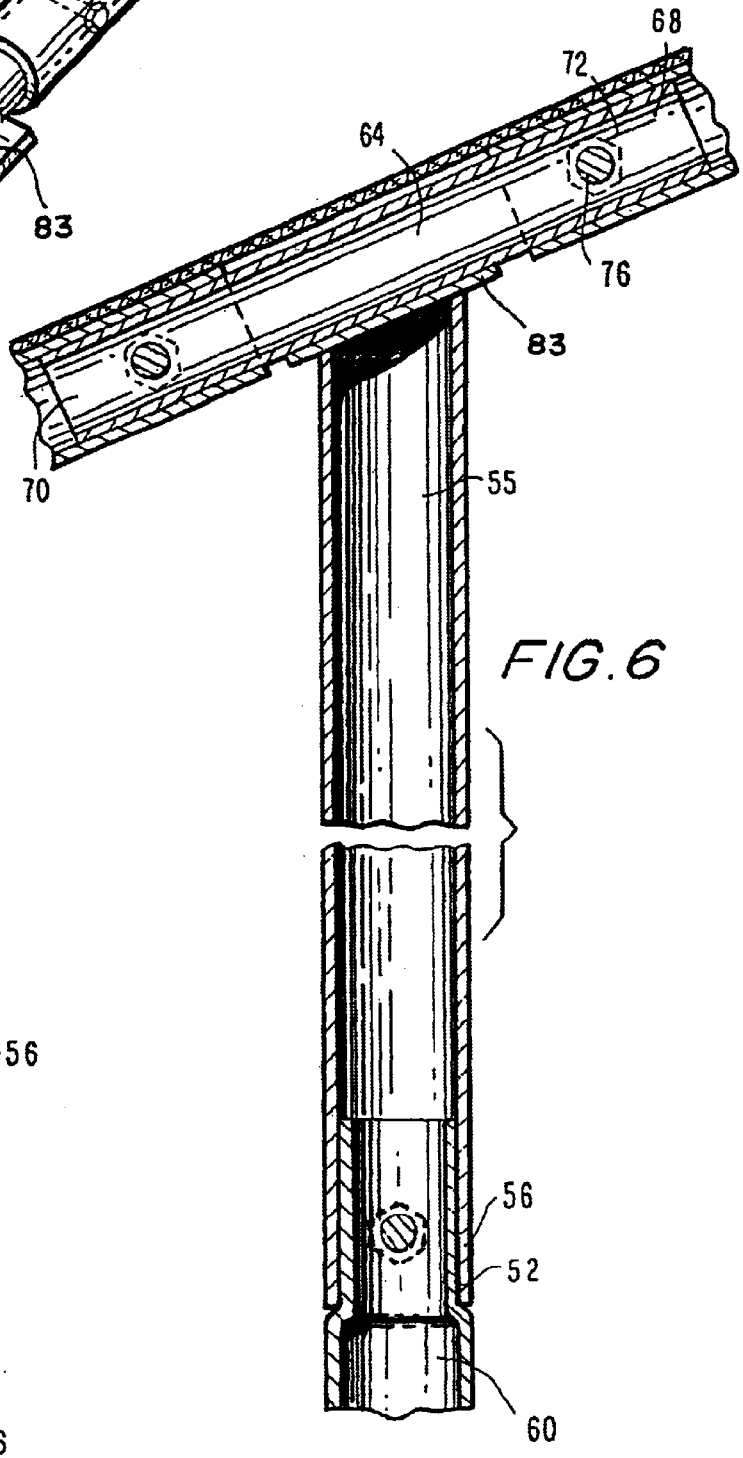
FIG. 6

FIG. 9
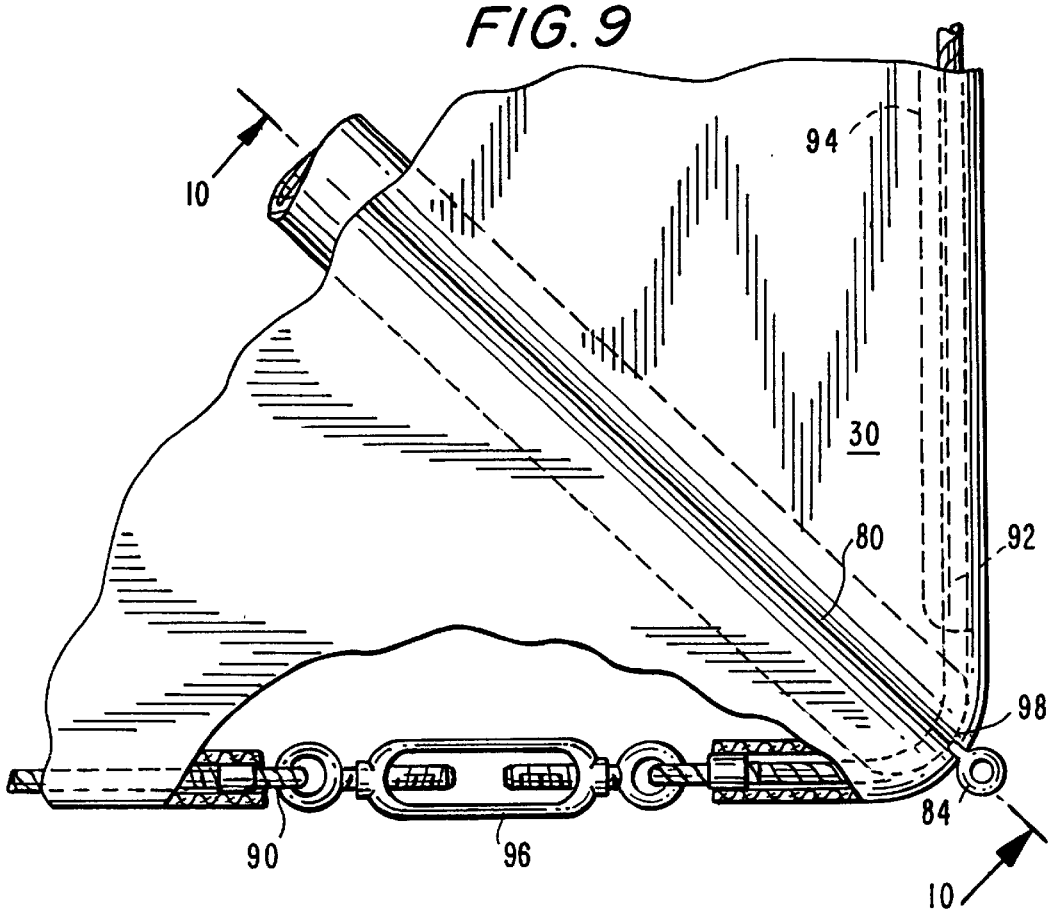
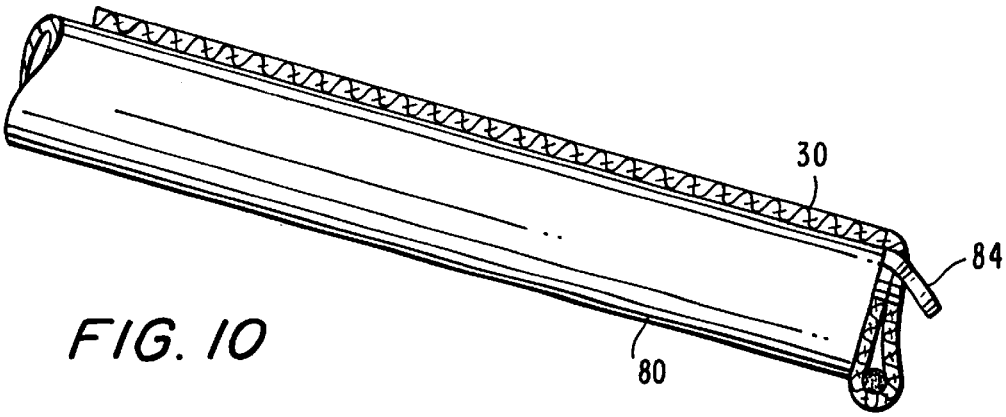
FIG. 10

CHILDRENS' PLAY AREA SUNSHADE CANOPY

BACKGROUND OF THE INVENTION

This invention relates generally to de-mountable sunshade canopy structures and in particular sunshade canopies for ultraviolet (UV) sun ray protection of childrens' play areas.

It is increasingly acknowledged that physically challenging outdoor play structures are of benefit to the physical and emotional development of young children. A code of safety specifications for the construction and maintenance of childrens' play structures has been developed by National Play and Playground Authorities, published (1996) by the National Recreation and Park Association Arlington, Va. These construction specifications describe construction features for support of childrens' slides, swings, climbing apparatus, etc. which minimize risk of injury to children engaged in all manner of predictable use and misuse of the play structures.

The specifications require that the play structures be mounted on a platform or on towers elevated up to six feet above a resilient (non-hardened) surface such as cork or rubber panels, and the towers or platform be supported by a very limited number of support columns. The columns are to be capped at the top and without exterior fittings on which a child could be caught or injured while climbing upon or falling from the platform or tower. The support columns are capped at the top to discourage a child from climbing or holding on suspended from the column top. The vertical support columns have been in the past a source of injures to children engaged in unintended use of these structures. Accordingly, the minimum number of vertical support columns, all free of hand or foot holds, has become a specification for acceptable safe design.

Separate from the safe construction design specifications referred to above which have and are significantly reducing playground injuries there is a growing theat to childrens' health when they are engaged in outdoor play and exercise in the sun shine.

The earth's protective atmosphere ozone layer has been significantly depleted due to release of chemical pollutants into the atmosphere during the last five decades. The result of the ozone depletion is that the solar ultraviolet (UV) rays are significantly more intense and comprise a serious health risk to children without protection when playing in the now unfiltered UV sun radiation.

In 1930 the risk of developing melanoma from sun exposure was 1 in 1500 people. Today a person's risk of developing skin cancer at some time during their life as a result of UV exposure is 1 in 75 people. Skin cancer is the most common cancer in the United States, with more than one million new cases diagnosed each year. Currently this year 47,700 Americans will be diagnosed with life threatening melanoma and 7,700 will die of the disease. The current prognosis for this disease is that approximately 1 out of 5 children in the United States will experience some form of skin cancer during their lifetime. Furthermore, exposure to the current intensity of solar UV radiation reduces the effectiveness of the immune system. This effect is of special importance in children's health.

Sources of the above statistics are to be found in publications of the American Academy of Dermatology, American Cancer Society, National Institutes of Health, U.S. Center for Disease Control and Protection and the Australian Cancer Society.

OBJECTS OF THE INVENTION

It is a first object of our invention to provide a sturdy, wind resistant, demountable canopy structure suitable for shading a childrens' play area from direct rays of the sun.

Another object of our invention is to provide a sturdy, wind resistant, demountable sun shade canopy for mounting on vertical support columns as used in childrens' standard safe outdoor play structures. The sun shade canopy structure as described herein, is in full compliance with recommended safety specifications for childrens' play areas.

Still another object of our invention is to provide a sturdy, wind resistant, demountable sun shade canopy design adaptable to retrofit existing small area and extended childrens' play area installations with effective sun shade protection.

These and other objects and advantages and diverse uses of our invention will be apparent from consideration of the following illustrations, specifications and claims.

BRIEF SUMMARY OF THE INVENTION

A demountable, wind resistant sun shade canopy suitable for mounting on a limited number of vertical columns, erected for the purpose of, or suitable for mounting on, extensions of a limited number of standard safe play area support columns. The canopy support structure, comprised of a plurality of uniquely shaped brackets which, when each is fixedly mounted, respectively, to the top of a vertical column, provides at each column a mount for a cantilever extending outward toward the perimeter of the area to be shaded, and simultaneously provides for mount of a hip beam extending toward the inner portion of the area to be shaded. Thus an extended-area rigid support structure is provided over a designated area which may be dependably shaded from the sun rays when a high density knitted polyethylene porous canopy cover is placed over the unique bracket supported plurality of cantilever and hip beam support members and secured about the perimeter of the canopy cover with an adjustable tension means.

BRIEF DESCRIPTION OF THE DRAWINGS

FIG. 1 is a perspective view of a portion of an existing safe play structure without sun protection; the play structure is shown mounted above a resilient ground cover.

FIG. 2 is a cross section of the upper portion of a support column taken along the plane 2—2.

FIG. 5 is a perspective view of a construction bracket for mounting cantilever beam and hip beam members to form a support structure for mounting the canopy cover.

FIG. 6 is a cross section of the construction bracket shown in FIG. 5 taken on the plane 6—6.

FIG. 9 shows detail of means for fastening the canopy cover to the support structure with adjustable tension means.

FIG. 10 shows a section of an extended end of the cantilever member showing means for securing the canopy cover.

DETAILED DESCRIPTION OF THE INVENTION

Figure 3:
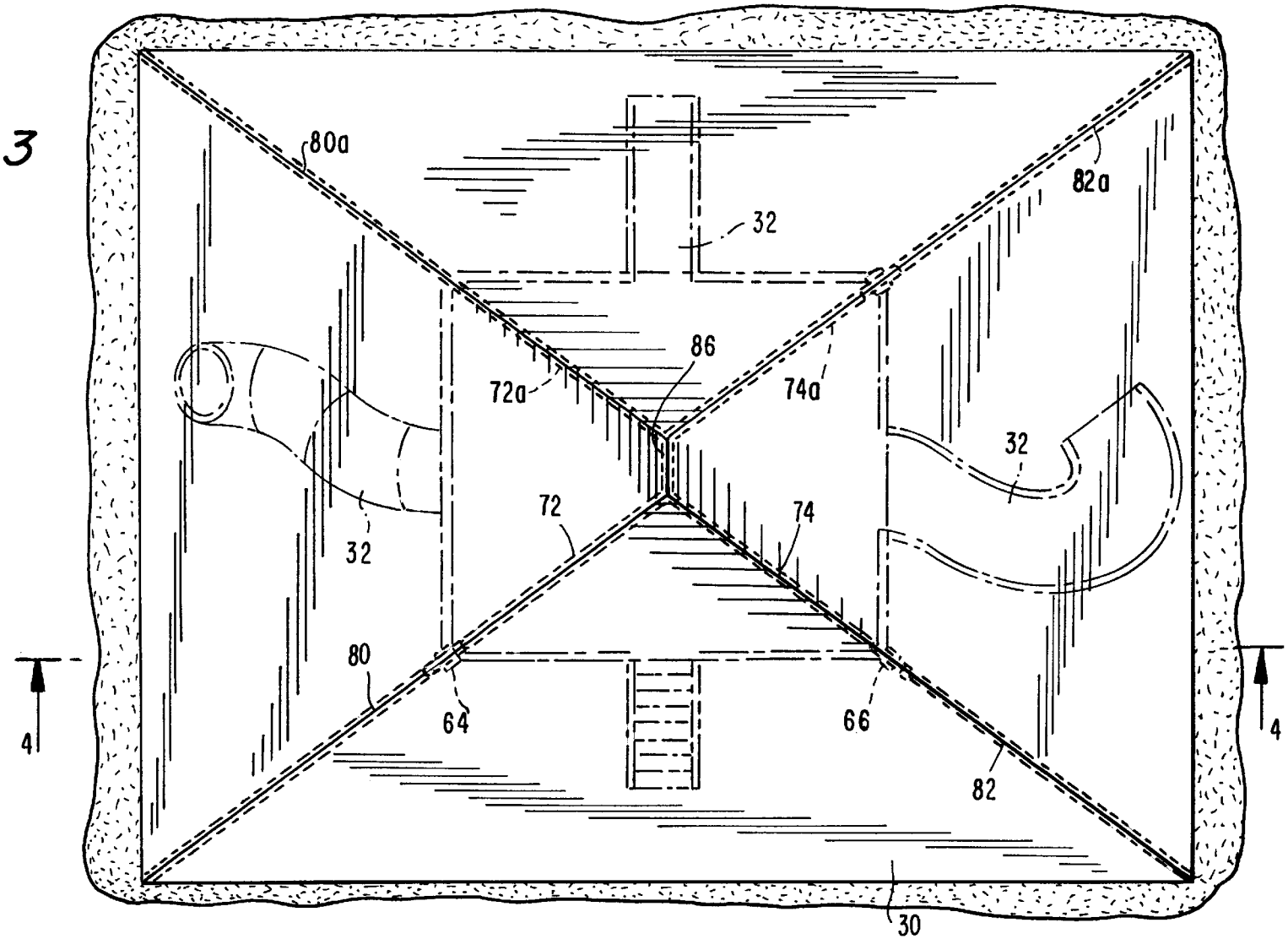
FIG. 3 is a plane view of a specified safe design single tower childrens' play area on which our innovative sun shade canopy has been erected; the play and exercise devices are shown in phantom lines.

A safe design childrens' play structure is illustrated in FIG. 1 wherein a plurality of fixedly mounted vertical columns 12*a*, 12*b*, 12*c* and 12*d* are shown. The columns 12*a*, 12*b* etc. are mounted in foundations (not shown) beneath a resilient ground cover 14. The ground cover may be made of rubber or cork matted materials to soften impact and reduce injuries to a child falling thereon.

The columns support a platform 16 from which a slide 18, a closed chute 20 and other childrens' climbing and exercise devices may be positioned.

The upper end of conventionally designed vertical columns 12*a*, 12*b*, 12*c*, 12*d* is shown in FIG. 2 in cross section on plane 2—2. A column cap 22 fits over the top of the column 12*d*. The cap 22 is shaped with a reduced diameter lower section 24 which, when inserted into the hollow opening 26 of the vertical column, comprises a secure mount for the column cap. Although such conventionally designed columns are fully compatible with the invention, in order to avoid the possibility of rainwater leaking into the seam between lower portion 24 and column 12*d*, it is preferable to have the columns designed as depicted in FIG. 6, where the upper end of column 12*a*, 12*b*, etc. has a smaller diameter than bracket 52 so that rainwater will flow over the juncture between the two without entering the seam.

FIGS. 1 and 2 are illustrative of safe childrens' play structures in compliance with the safety specifications developed by the National Play and Playground Authorities, At this date there are tens of thousands of such play structures erected and being erected in the United States without provision for effective sun shade for children using such structures.

A plan view of a first embodiment of our invention is shown in FIG. 3 wherein a canopy cover 30 is shown supported over structural members described below which in turn are mounted above a children's play structure area. Children's exercise and play devices are shown at 32 in phantom lines below the canopy 30.

Figure 4:
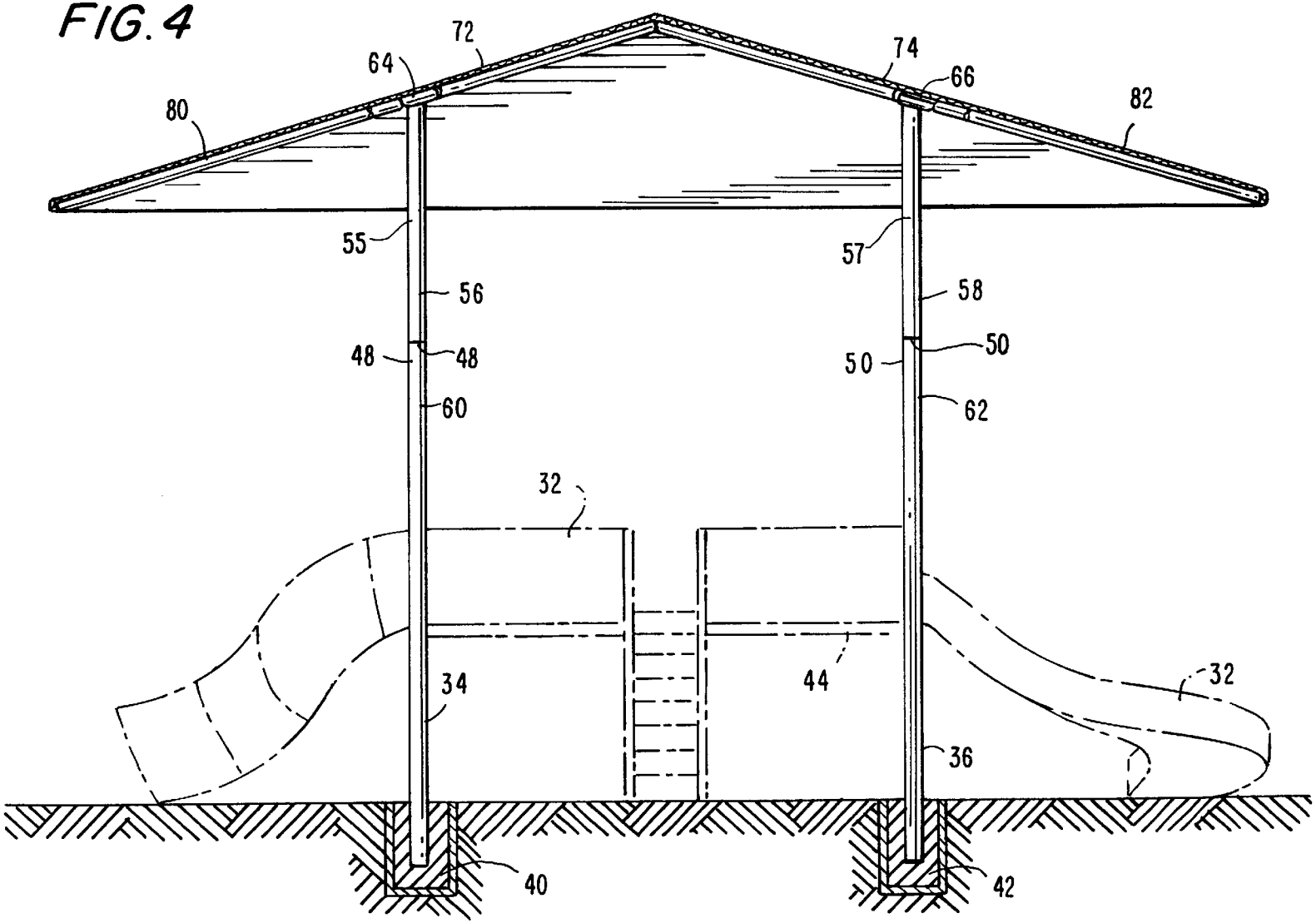
FIG. 4 is a sectional elevation view of the embodiment of our invention shown in FIG. 3 with portions of the play structures and canopy support members shown in phantom.

A cross section elevation of the FIG. 3 embodiment is shown in FIG. 4 taken on plane 4—4. Vertical columns 34 and 36 are fixedly mounted respectively in concrete foundation footings 40 and 42. The vertical columns support a platform or deck 44. The columns 34,36 terminate at approximately four feet above the platform or deck 44. Caps 22 such as shown in FIG. 2 have been removed from the upper column portions 60,62 of the columns 34, 36 exposing the tops 48, 50 respectively, of columns 34 and 36. Structural bracket fittings 55 and 57 have lower ends 56, 58, which, fit over the tops 48,50 of columns 34 and 36.

FIGS. 5 and 6 are illustrative of the structural brackets fittings 55 and 57; more specifically, FIG. 5 depicts bracket 55 in a perspective cut-away fragmentary view while FIG. 6 is a view of the structural bracket 55 shown as a cross section on plane 6—6. In preferred embodiments, the lower portion 56 of structural bracket 55 fits over the reduced diameter upper end 52 of the upper column portion 60. In rainy weather, water will flow over the juncture of lower portion 56 and upper end 52 and will not enter the seam where it might cause damage.

The upper end of the bracket is terminated with a transverse angularly mounted cylindrical rod 64. The rod 64 is mounted at an acute angle with the vertical cylinder extension. The angle with the horizontal is normally 22 degrees, but is subject to adjustment as required for specific application.

Mounted as shown in FIG. 5 and FIG. 6, the cylindrical rod 64 is mounted on a plate 83 which in turn is mounted at an angle relative to the horizontal to bracket rod 55, said bracket rod 55 has an upper or first end 68, and a lower or second end 70. Hip beam 72 comprises a straight section of a hollow metal steel pipe or rod. The hip beam 72 is positioned over the upper, or first end 68, of the angle mounted cylindrical rod 64 and secured with threaded bolt means 76 passed through the hip beam 72 and the cylindrical rod 64.

The lower or second end 70 of the solid metal rod 64 is mounted over a cantilever beam 80 comprised of a straight section of hollow steel pipe at its upper end and secured with threaded means 81. The lower end of the cantilever beam is terminated with an oblong eyelet connector 84.

Figure 7:
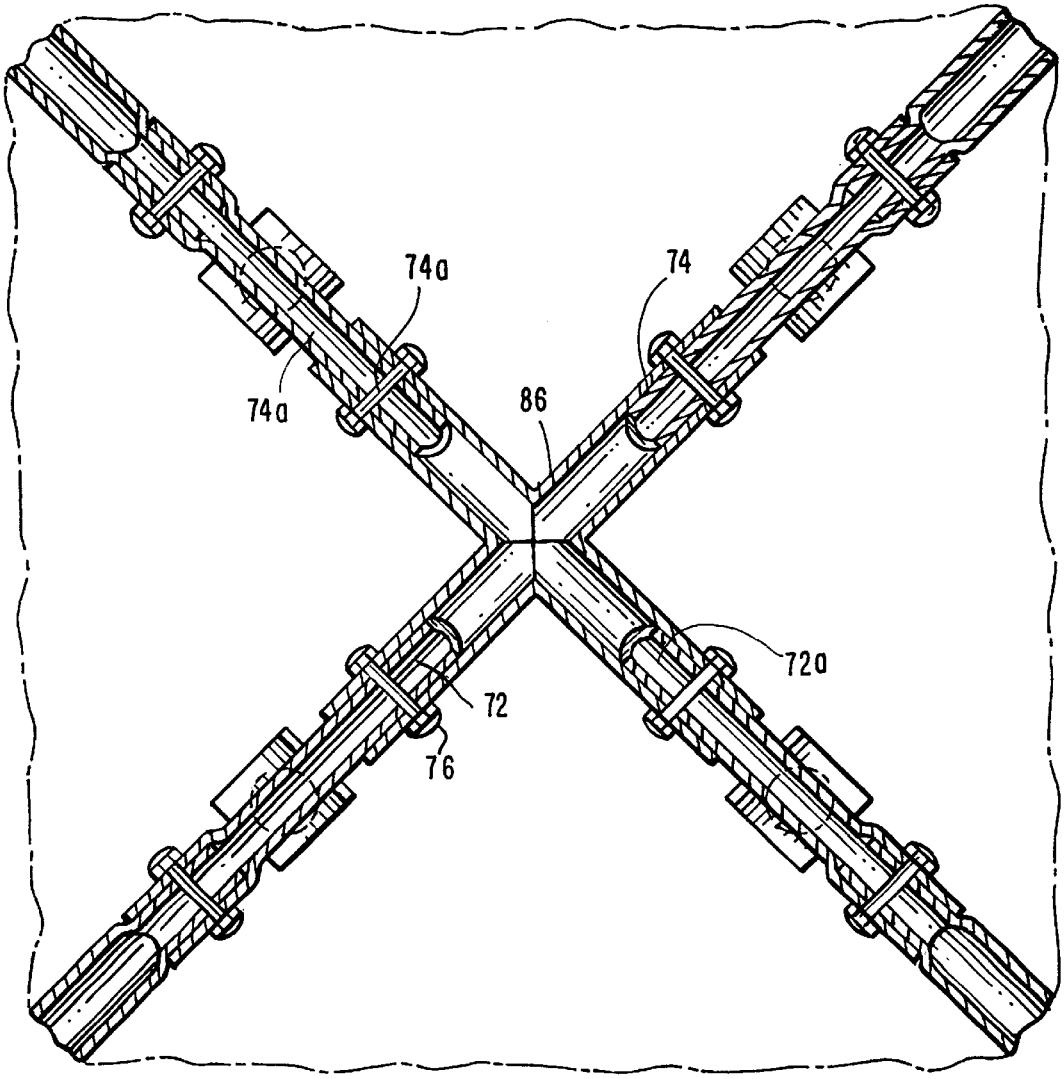
FIG. 7 is a plane view of the connector for the four hip beam canopy support members shown in the embodiment of our sun shade canopy illustrated in FIGS. 3 and 4.
Figure 8:
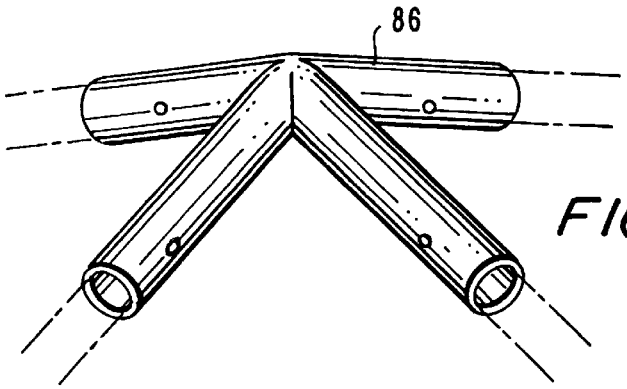
FIG. 8 is a perspective view of the hip beam connector illustrated in FIG. 7.

As shown in fragment view in FIGS. 7 and 8 the four hip beams 72,74 and counter parts 72*a*, 74*a* terminate in juxtaposition and are secured together with a right angle joint 86.

Referring now to FIG. 3, a porous woven polyethylene canopy cover 30 is placed over the structure comprised of hip beam members 72, 72*a*, 74, 74*a*, and cantilever beam members 80, 80*a*, 82, 82*a*. The canopy details are more clearly shown in FIG. 9. The canopy cover 30 is secured about its perimeter with a tension cable 90 which is secured within a cable channel 92 sewn about the canopy perimeter 94. The tension on the cable 90 is adjusted and maintained with a turnbuckle 96. The canopy cover 30 is provided at its four corners with a reinforced opening 98 through which the oblong eyelet connector 84 located on the extreme end of the cantilever beam 80 and its counterpart cantilever beams 82, etc. protrudes.

Figure 11:
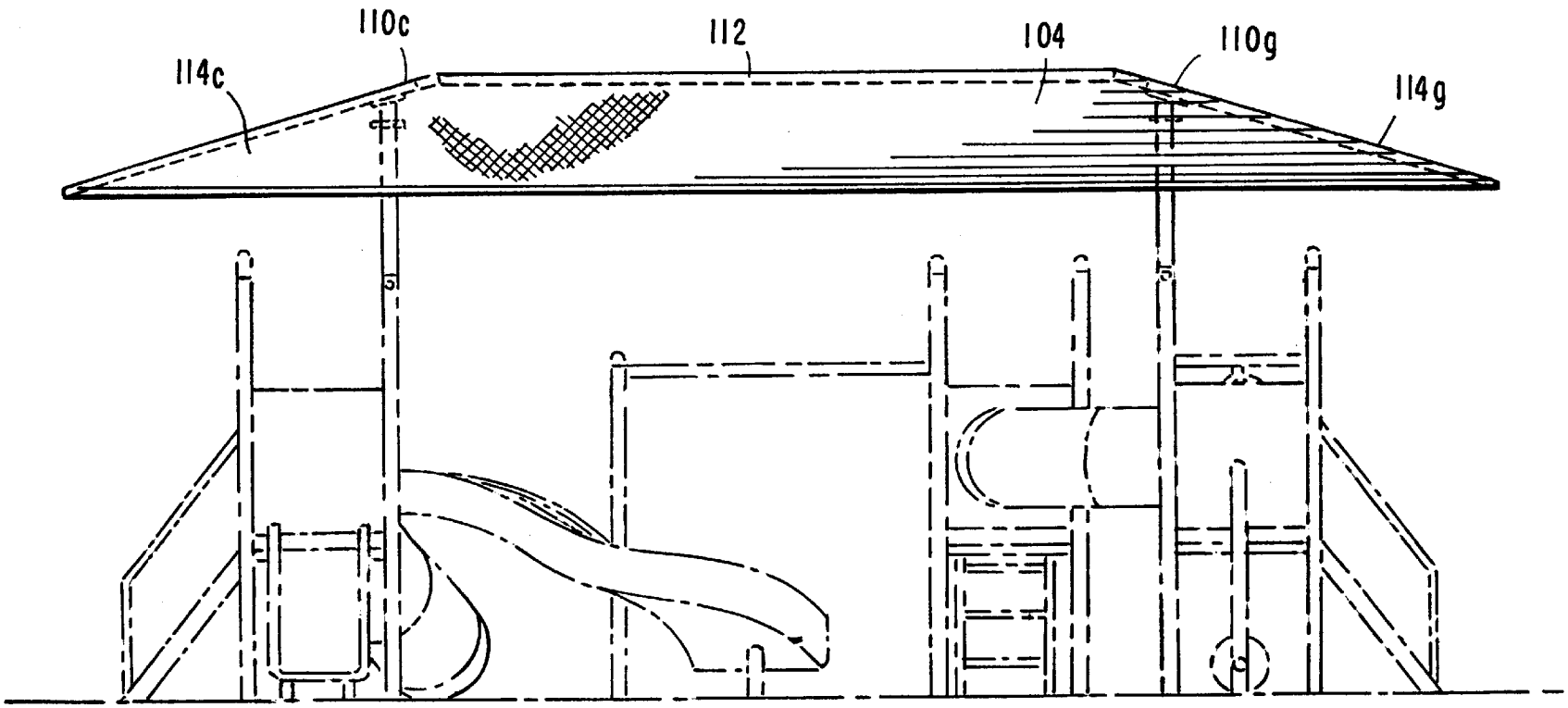
FIG. 11 is an elevation view of a second embodiment of our sun shade canopy structure mounted to cover a two tower specified safe children's play area.
Figure 12:
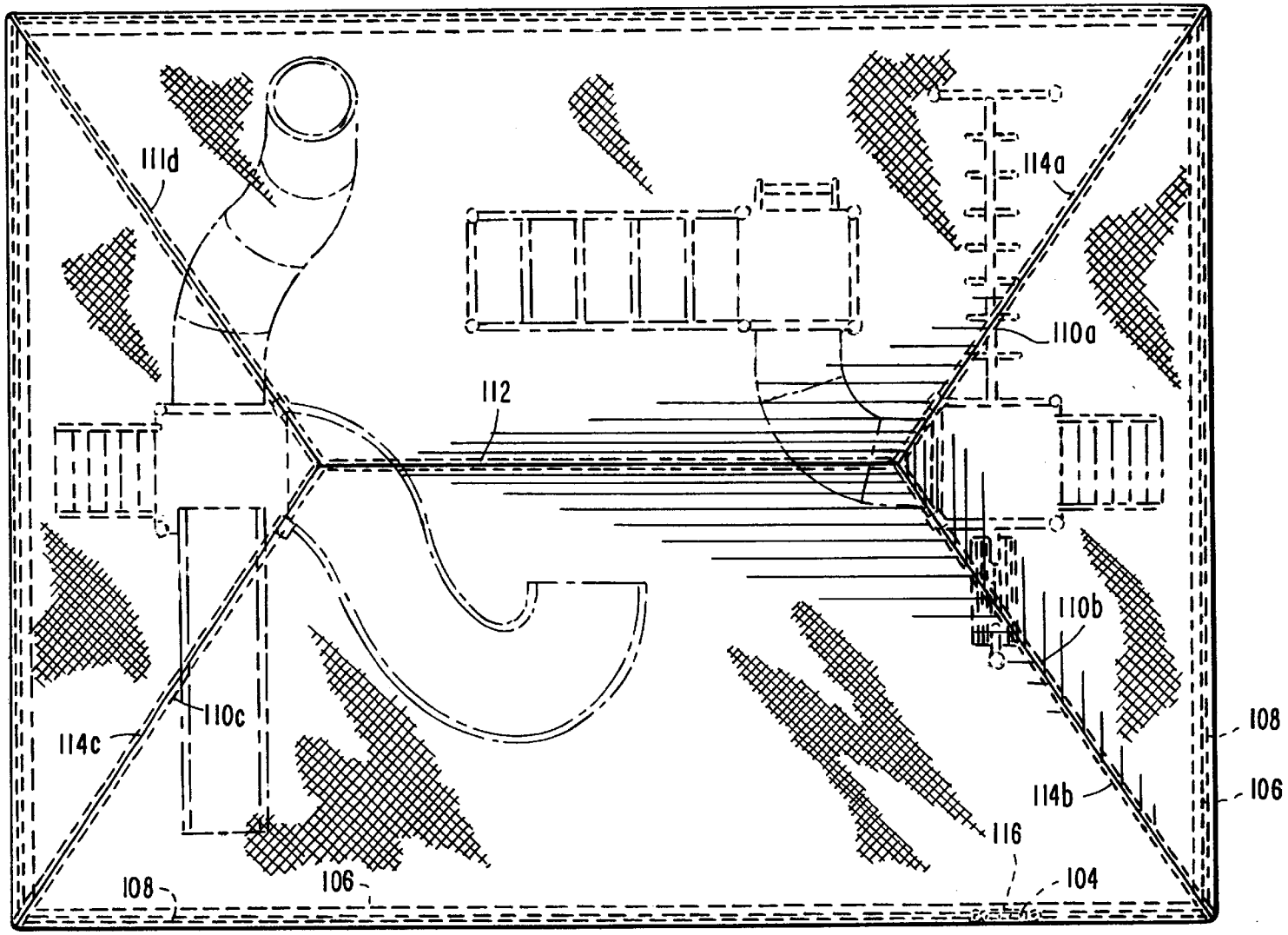
FIG. 12 is a plane view of the embodiment of our sun shade canopy shown in the embodiment illustrated in FIG. 11. The children's play area devices are shown in phantom.

A second embodiment of our invention is illustrated in FIGS. 11 and 12 wherein a two tower safe design children's play area is shown. The play and exercise devices are shown in phantom lines. A porous shade canopy 104 fabricated with woven polyethylene strips is constructed similarly to the single tower canopy cover 30. The two tower canopy cover 104 is sewn so that it provides a cable channel 106. A tension cable 108 is threaded through the channel 106 and when positioned over the metal support structure of hip beams 110*a*, 110*b*, 110*c*, etc. ridge beam 112 and cantilever beams 114*a*, 114*b*, 114*c*, etc. forms a sunshade canopy. A turnbuckle tension means 116 is attached to the ends of the cable 108 to provide adjustment and to maintain cable tension.

The canopy cover 104 is provided at each corner with a reinforced opening 98 as shown in FIG. 9, through which the oblong eyelet connector 84 on the cantilever beam extends.

The purposes and other advantages to our invention and possible application to sun sheltering purposes beyond those described in connection with children's play areas will be apparent from the following claims.

What is claimed is:

1. A demountable wind resistant sun shade canopy for shading a children's play area or other actively used areas comprising a plurality of vertical columns having, respectively, upper ends, a plurality of structural connector brackets mounted on said column upper ends, said structural brackets each having a rod mounted on said bracket at an angle relative to the horizontal, each of said rods, respectively, having upper and lower ends, a plurality of cantilever beams, each of said plurality of cantilever beams having means thereon for being secured to said lower ends of said rods, and a plurality of hip beams, the hip beams, respectively, having means thereon for being secured to said upper ends of said rods, and a sun shade canopy cover being formed of porous woven polyethylene strips, means for tensioning said cover at its periphery when said cover is placed over said hip beams and said cantilever beams, wherein said means for tensioning is operative at lower ends of said cantilever beams.

2. A demountable sun shade canopy structure comprised of a plurality of fixedly mounted vertical column members, said vertical column members respectively, open hollow upper ends, a plurality of structural brackets, each comprised of a hollow cylindrical lower section interfitted with each of said open hollow ends of each of said column member ends, each of said brackets is provided with a short cylindrical rod mounted thereon at an acute angle relative to the horizontal, each of said rods has an upper end and a lower end, a straight hip beam member is securely mounted to said upper end of each of said angular rods, means for securely attaching respective upper ends of said hip beam members together, and a plurality of cantilever beams, each being securely mounted to each of said lower ends of said angular and short cylindrical rods, a lower end of said cantilevered beams each having an eyelet extending axially therefrom and a porous woven cover, said woven cover is provided with a channel sewn about its perimeter, a cable with means for tensioning is positioned within said channel, said porous cover is supported over said hip beams and is extending over said cantilever beams, said canopy cover is secured at said perimeter by said curved hooks on said cantilever beams and is further secured held in tension by said means for tensioning in said sewn channel, whereby a demountable sun shade canopy is securely supported over said hip beams and said cantilever beams to provide shade from direct sun light for an area below said canopy.

3. A light weight wind resistant broad area sun shade canopy including four vertical support columns, each column having, respectively, rigidly mounted lower ends and open sleeve upper ends, four hip beam canopy support members each comprised of a horizontal base including a vertical insert member adapted to securely interfit with said upper ends, means for mounting a connector rod at an upper end at each of said connector joint members, said means for mounting constitutes a plate being connected to said connector joint at an acute angle to an upper end of said vertical insert member, said connector rod having an upper end and a lower end, a cylindrical hip beam member adapted to fit telescopically over said upper end of said connector rod and means for securing said hip beam member to said upper end of said connector rod, a cantilever beam member adapted to fit telescopically over said lower end of said connector rod including means for fastening said cantilever beam member to said lower end of said connector rod, means for fastening at least four of said hip beam members together at their respective upper ends by hollow tube members, a knitted sun ray resistant canopy cover is placed over said at least four hip beam members, said at least four hip beam members and said at least four cantilever beam members, said canopy cover is being secured with a peripheral tensioning means, whereby a sun ray shade canopy is provided over an extended area.

4. A sun shade canopy structure cover in combination over a children's play area, said canopy structure combination and said canopy structure comprising a limited number of safety compliant vertical columns having end openings including brackets attached to said upper end thereon at an acute angle from the horizontal, a connector tube is mounted on each of said plates and follows the direction of said plate, each of said tubes has an upper end and a lower end, a hip beam member is mounted on each upper end of said connector tubes, said hip beam members are positioned so as to converge at their respective upper ends including means for firmly attaching together said upper ends, a cantilever member is attached to each of said connector tubes at their respective lower ends thereof, said cantilever members are telescopically interfitted with said lower ends of said connector tubes, a ridge beam constituting means for connecting a first set of said converged hip beam members to a second set of said converged hip beam members together, a knitted canopy cover is positioned over and supported by said ridge beam, said plurality of hip beam members and said cantilever beam members, said canopy cover is being secured about its perimeter thereof with a tension member.

* * * * *